US010064484B2

(12) United States Patent
Tsai

(10) Patent No.: US 10,064,484 B2
(45) Date of Patent: Sep. 4, 2018

(54) LIFT TABLE

(71) Applicant: SING BEE ENTERPRISE CO., LTD., Nantou, Nantou County (TW)

(72) Inventor: Chi-Cheng Tsai, Nantou (TW)

(73) Assignee: Sing Bee Enterprise Co., Ltd., Nantou (TW)

( * ) Notice: Subject to any disclaimer, the term of this patent is extended or adjusted under 35 U.S.C. 154(b) by 0 days.

(21) Appl. No.: 15/682,669

(22) Filed: Aug. 22, 2017

(65) Prior Publication Data

US 2018/0064244 A1 Mar. 8, 2018

(30) Foreign Application Priority Data

Sep. 6, 2016 (TW) ..... 105213682 U

(51) Int. Cl.

| | |
|---|---|
| ***A47B 41/00*** | (2006.01) |
| ***A47B 41/02*** | (2006.01) |
| ***A47B 9/20*** | (2006.01) |
| *A47B 9/00* | (2006.01) |

(52) U.S. Cl.

CPC ..... *A47B 41/02* (2013.01); *A47B 9/20* (2013.01); *A47B 2009/003* (2013.01); *A47B 2200/0043* (2013.01)

(58) Field of Classification Search

CPC .. A47B 41/02; A47B 9/00; A47B 9/10; A47B 2009/003; A47B 21/02; A47B 2200/0041; A47B 2200/0042; A47B 2200/0043

See application file for complete search history.

(56) References Cited

U.S. PATENT DOCUMENTS

| | | | | |
|---|---|---|---|---|
| 6,038,986 | A * | 3/2000 | Ransil | A47B 9/02 108/145 |
| 6,283,047 | B1 * | 9/2001 | Haller(-Hess) | A47B 9/02 108/145 |
| 7,140,306 | B2 * | 11/2006 | Chen | A47B 17/02 108/138 |
| 9,055,810 | B2 * | 6/2015 | Flaherty | A47B 9/18 |
| 9,924,793 | B2 * | 3/2018 | Flaherty | A47B 9/16 |
| 2006/0075933 | A1 * | 4/2006 | Ohlson | A47B 21/02 108/10 |
| 2009/0095868 | A1 * | 4/2009 | Ohlson | A47B 21/02 248/371 |
| 2017/0127821 | A1 * | 5/2017 | Carter | A47B 5/00 |
| 2017/0290413 | A1 * | 10/2017 | Hu | A47B 21/02 |

* cited by examiner

*Primary Examiner* — Daniel J Rohrhoff

(57) ABSTRACT

A lift table includes a base unit having a supporting beam connected between two legs. An elongated member is connected to a first linking rod, a second linking rod and a third linking rod and is pivotably connected to the legs. The first linking rod, the second linking rod and the third linking rod are pivotable together with the elongated member relative to the legs and are, thus, pivotable relative to the base unit. A telescopic actuator includes two ends pivotably connected to the supporting beam and the second linking rod, respectively. A top board unit is pivotably connected to the first and third linking rods and includes a switch operable to actuate the actuator to proceed with a telescope movement, causing the first and third linking rods to pivot relative to the legs, thereby lifting or lowering the top board unit.

8 Claims, 7 Drawing Sheets

LIFT TABLE

BACKGROUND OF THE INVENTION

The present invention relates to a lift table and, more particularly, to a lift table permitting adjustment of a height and an inclination angle of a top board of the lift table.

Taiwan Utility Model No. M243106 discloses a height-adjustable lift table including a torsional element connected to a telescopic cylinder through two cranks. The torsional element rotates when the cylinder is actuated under a pressure. A telescopic rod is received in the cylinder and includes a distal end having a contact point remote to the cylinder. The telescopic rod is connected to an adapter board through a supporting board and is then connected to a main board. A pressing board is mounted to an end of the adapter board and is connected to an auxiliary board via a cable. The pressing board is normally in slight contact or does not contact with the contact point. When the cable is pulled, the pressing board exerts a force on the contact point and, thus, presses the contact point to actuate the cylinder, which, in turn, releases pressure and pushes out the telescopic rod. Since an end of the telescopic rod is fixed to the adapter board, the telescopic rod pushes the cylinder away from the main board. Thus, the cranks are moved to pivot the torsional element.

Since the telescopic rod is connected to the supporting board that is connected to the main board, the cylinder can slide relative to the telescopic rod to adjust the height of the auxiliary board. The main board is maintained at the same height of the auxiliary board through the telescopic rod and the cylinder. However, when the auxiliary board is subject to an external force, the main board generally made of wood is apt to deform, leading to an insecure structure.

BRIEF SUMMARY OF THE INVENTION

An objective of the present invention is to provide a lift table that mitigates and/or obviates the above problem.

A lift table according to the present invention includes a base unit, a linking rod unit, an actuator, and a top board. The base unit includes a first leg, a second leg, and a supporting beam connected between the first leg and the second leg. The linking rod unit includes an elongated member, a first linking rod, a second linking rod, and a third linking rod. The elongated member is connected to the first linking rod, the second linking rod and the third linking rod and is pivotably connected to the first leg and the second leg. The first linking rod, the second linking rod and the third linking rod are pivotable together with the elongated member relative to the first leg and the second leg and are, thus, pivotable relative to the base unit. The actuator includes a first end pivotably connected to the supporting beam and a second end pivotably connected to the second linking rod. The actuator is telescopic. The top board unit is pivotably connected to the first linking rod and the third linking rod and includes a switch. The switch is operable to actuate the actuator to proceed with a telescope movement, causing the first linking rod to pivot relative to the first leg and causing the third linking rod to pivot relative to the second leg, thereby lifting or lowering the top board unit.

In an example, the supporting beam includes a supporting portion. The actuator includes a cylinder, a push rod, and an actuating portion. The cylinder is pivotably connected to the supporting portion. The push rod includes a first end slideably received in the cylinder and a second end. The actuating portion is connected to the second end of the push rod and is pivotably connected to the second linking rod. The top board unit includes an actuation cord having a first end connected to the switch and a second end connected to the actuating portion. When the switch is not pressed, the push rod is not slideable relative to the cylinder. When the switch is pressed, the actuating portion is actuated via the actuation cord, and the push rod is slideable relative to the cylinder.

In an example, the linking rod unit further includes a fourth linking rod connected to the elongated member and located between the second linking rod and the third linking rod. The fourth linking rod and the second linking rod are respectively connected to two opposite sides of the actuating portion. The second linking rod and the fourth linking rod are synchronously pivotable relative to the base unit.

In an example, the supporting beam further includes an extension portion having a first end connected to the first leg and a second end connected to the second leg. The supporting portion is connected to an end of the extension portion adjacent to the first leg. The elongated member includes two connecting portions and a beam portion. The two connecting portions are respectively located on two opposite ends of the beam portion. One of the two connecting portions is pivotably connected to the first leg. The other connecting portion is pivotably connected to the second leg. The beam portion is connected to the first linking rod, the second linking rod, the third linking rod, and the fourth linking rod.

In an example, the first linking rod includes a first through-hole. The second linking rod includes a second through-hole. The third linking rod includes a third through-hole. The fourth linking rod includes a fourth through-hole. The elongated member extends through the first through-hole, the second through-hole, the third through-hole, and the fourth through-hole.

In an example, the extension portion includes square cross sections. The beam portion includes square cross sections. Each of the first through-hole, the second through-hole, the third through-hole, and the fourth through-hole includes square cross sections corresponding to the square cross sections of the beam portion.

In an example, the top board unit includes a first adjusting member, a first connecting member, a first knob, and a top board. The first adjusting member includes a first adjusting track, a first pivotal portion, and a second pivotal portion. The first adjusting track extends from a first side of the first adjusting member through a second side of the first adjusting member opposite to the first side of the first adjusting member. The first pivotal portion is located between the first adjusting track and the second pivotal portion. An end of the first linking rod remote to the elongated member is pivotably connected to the first pivotal portion. The first connecting member is pivotably connected to the second pivotal portion of the first adjusting member and includes a first screw portion slideably extending through the first adjusting track. The first knob is in threading connection with the first screw portion and selectively presses against the first adjusting member, such that the first connecting member and the first knob clamp the first adjusting member. The first connecting member is connected to the top board. The switch is mounted to an end of the first connecting member remote to the second pivotal portion.

In an example, the top board unit further includes a second adjusting member, a second connecting member, and a second knob. The second adjusting member includes a second adjusting track, a third pivotal portion, and a fourth pivotal portion. The second adjusting track extends from a first side of the second adjusting member through a second side of the second adjusting member opposite to the first side of the second adjusting member. The third pivotal portion is located between the second adjusting track and the fourth pivotal portion. An end of the third linking rod remote to the elongated member is pivotably connected to the third pivotal portion. The second connecting member is pivotably connected to the fourth pivotal portion of the second adjusting member and includes a second screw portion slideably extending through the second adjusting track. The second knob is in threading connection with the second screw portion and selectively presses against the second adjusting member, such that the second connecting member and the second knob clamp the second adjusting member. The second connecting member is connected to a side of the top board opposite to the first connecting member.

In an example, the linking rod unit further includes a fifth linking rod and a sixth linking rod. The fifth linking rod includes a first end pivotably connected to the first leg and a second end pivotably connected to the second pivotal portion of the first adjusting member. The sixth linking rod includes a first end pivotably connected to the second leg and a second end pivotably connected to the fourth pivotal portion of the second adjusting member.

The present invention will become clearer in light of the following detailed description of illustrative embodiments of this invention described in connection with the drawings.

DETAILED DESCRIPTION OF THE INVENTION

Figure 1:
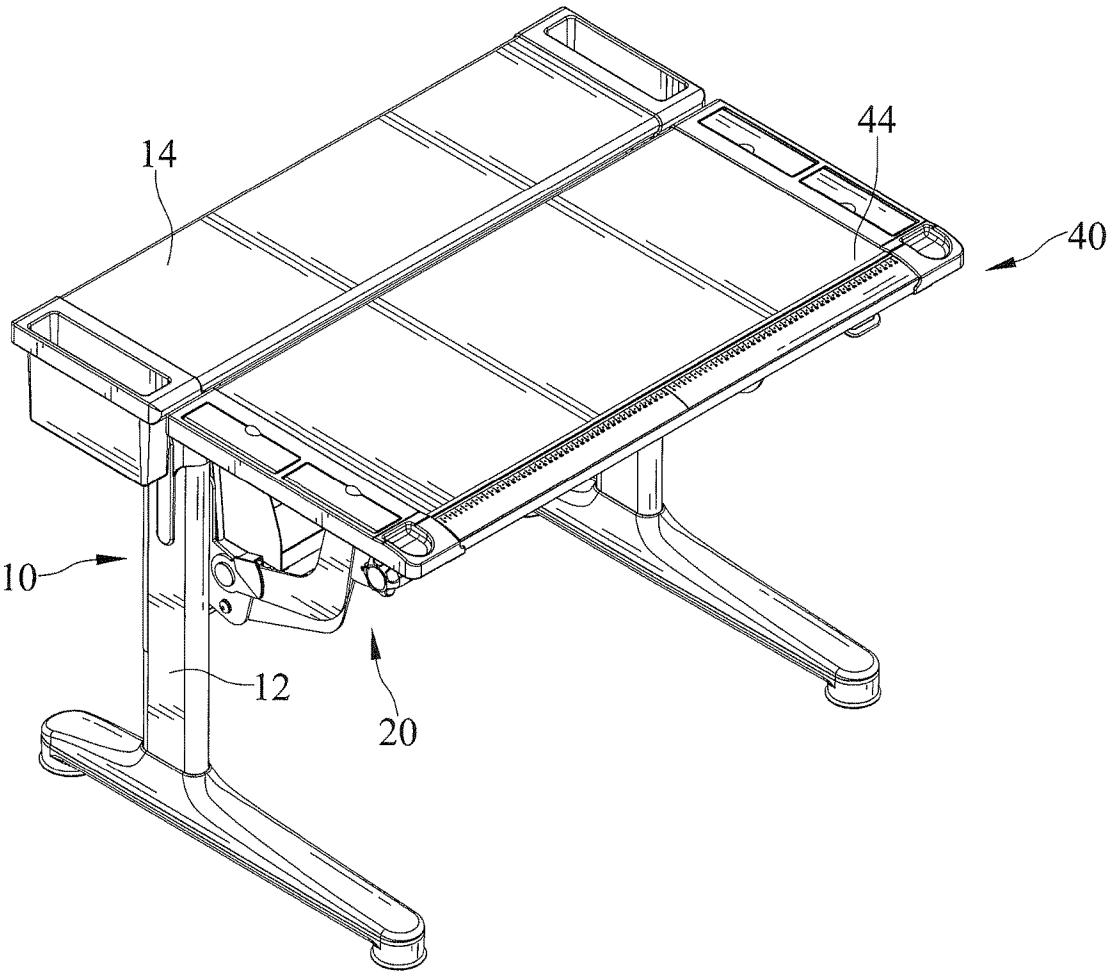
FIG. 1 is a perspective view of a lift table according to the present invention.
Figure 2:
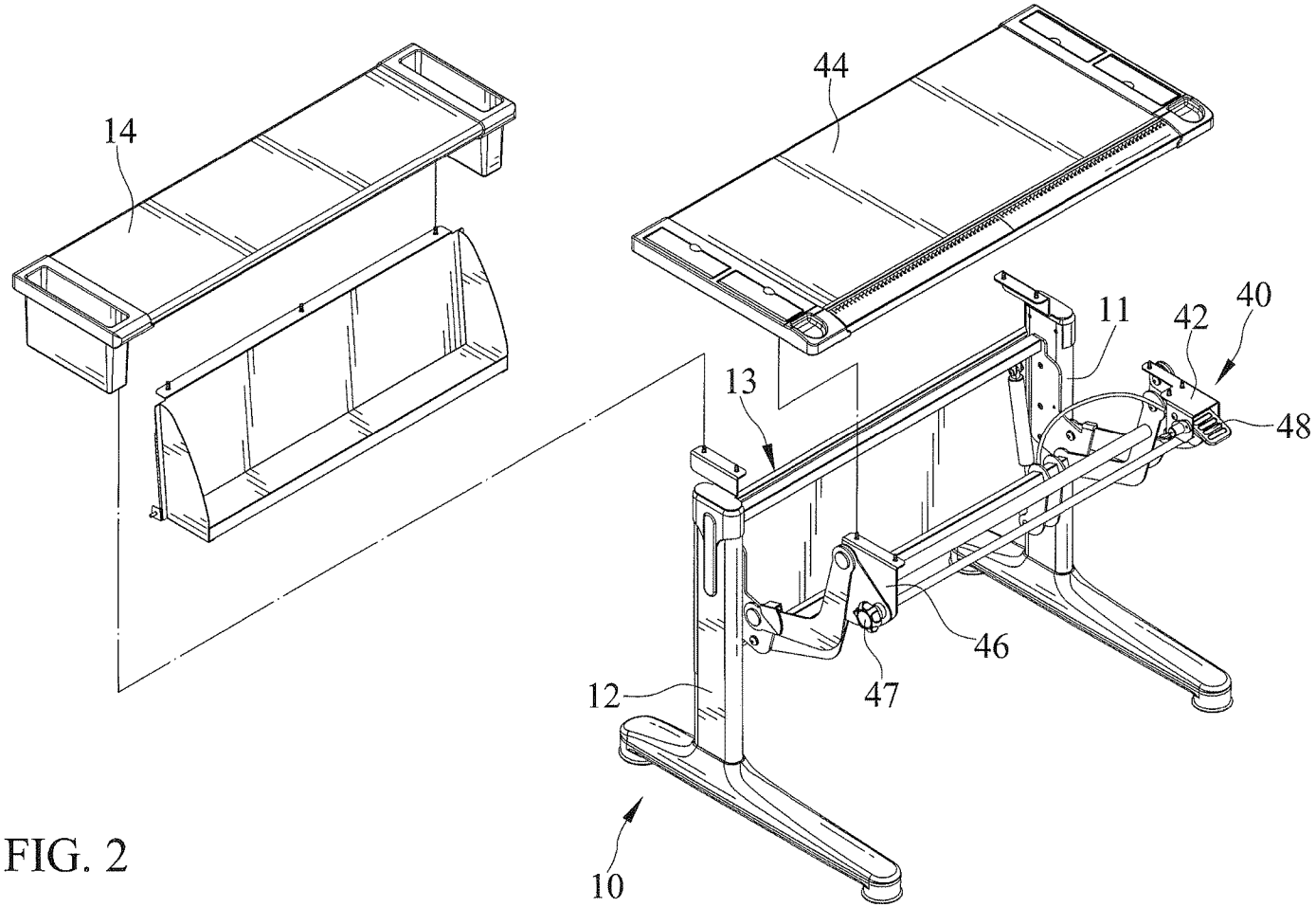
FIG. 2 is an exploded, perspective view of the lift table of FIG. 1.

With reference to FIGS. 1-5, a lift table according to the present invention includes a base unit 10, a linking rod unit 20, an actuator 30, and a top board unit 40. Two opposite ends of the linking rod unit 20 are pivotably connected to the base unit 10 and the top board unit 40, respectively. Two opposite ends of the actuator 30 are pivotably connected to the base unit 10 and the linking rod unit 20. The actuator 30 is telescopic to actuate the linking rod unit 20 to pivot relative to the base unit 10, thereby lifting or lowering the top board unit 40.

The base unit 10 includes a first leg 11, a second leg 12, a supporting beam 13, and a flat board 14. The supporting beam 13 is connected between the first leg 11 and the second leg 12. An end of the first leg 11 and an end of the second leg 12 are connected to the flat board 14. The supporting beam 13 is parallel to the flat board 14. The supporting beam 13 includes a supporting portion 131 and an extension portion 132. The extension portion 132 includes a first end connected to the first leg 11 and a second end connected to the second leg 12. The supporting portion 131 is connected to an end of the extension portion 132 adjacent to the first leg 11 and extends away from the flat board 14. In this embodiment, the extension portion 132 includes square cross sections.

The linking rod unit 20 includes an elongated member 21, a first linking rod 22, a second linking rod 23, a third linking rod 24, a fourth linking rod 25, a fifth linking rod 26, and a sixth linking rod 27. The elongated member 21 is connected to the first linking rod 22, the second linking rod 23, the third linking rod 24 and the fourth linking rod 25 and is pivotably connected to the first leg 11 and the second leg 12. The first linking rod 22, the second linking rod 23, the third linking rod 24, and the fourth linking rod 25 are pivotable together with the elongated member 21 relative to the first leg 11 and the second leg 12 and are, thus, pivotable relative to the base unit 10. The fourth linking rod 25 is located between the second linking rod 23 and the third linking rod 24. The fifth linking rod 26 includes a first end pivotably connected to the first leg 11 and a second end pivotably connected to the top board unit 40. The sixth linking rod 27 includes a first end pivotably connected to the second leg 12 and a second end pivotably connected to the top board unit 40.

The elongated member 21 includes two connecting portions 211 and a beam portion 212. The two connecting portions 211 are respectively located on two opposite ends of the beam portion 212. One of the two connecting portions 211 is pivotably connected to the first leg 11. The other connecting portion 211 is pivotably connected to the second leg 12. The first linking rod 22 includes a first through-hole 221. The second linking rod 23 includes a second through-hole 231. The third linking rod 24 includes a third through-hole 241. The fourth linking rod 25 includes a fourth through-hole 251. The elongated member 21 extends through the first through-hole 221, the second through-hole 231, the third through-hole 241, and the fourth through-hole 251. In this embodiment, the beam portion 212 includes square cross sections, and each of the first through-hole 221, the second through-hole 231, the third through-hole 241, and the fourth through-hole 251 includes square cross sections corresponding to the square cross sections of the beam portion 212.

The actuator 30 includes a cylinder 31, a push rod 32, and an actuating portion 33. The cylinder 31 is pivotably connected to the supporting portion 131. The push rod 32 includes a first end slideably received in the cylinder 31 and a second end. The actuating portion 33 is connected to the second end of the push rod 32 and is pivotably connected to the second linking rod 23 and the fourth linking rod 25. The actuating portion 33 is located between the second linking rod 23 and the fourth linking rod 25.

The top board unit 40 includes a first adjusting member 41, a first connecting member 42, a first knob 43, a top board 44, a second adjusting member 45, a second connecting member 46, a second knob 47, a switch 48, and an actuation cord 49. The first linking rod 22 and the fifth linking rod 26 are pivotably connected to the first adjusting member 41. The first connecting member 42 is pivotably connected to the first adjusting member 41 and is connected to the first knob 43. The first adjusting member 41 is located between the first connecting member 42 and the first knob 43. The third linking rod 24 and the sixth linking rod 27 are pivotably connected to the second adjusting member 45. The second connecting member 46 is pivotably connected to the second adjusting member 45 and is connected to the second knob 47. The second adjusting member 45 is located between the second connecting member 46 and the second knob 47. The first connecting member 42 and the second connecting member 46 are connected to two opposite sides of the top board 44, respectively. The switch 48 is mounted to the first connecting member 42. The actuation cord 49 includes a first end connected to the switch 48 and a second end connected to the actuating portion 33.

The first adjusting member 41 includes a first adjusting track 411, a first pivotal portion 412, and a second pivotal portion 413. The first adjusting track 411 extends from a first side of the first adjusting member 41 through a second side of the first adjusting member 41 opposite to the first side of the first adjusting member 41. The first pivotal portion 412 is located between the first adjusting track 411 and the second pivotal portion 413. An end of the first linking rod 22 remote to the elongated member 21 is pivotably connected to the first pivotal portion 412. The fifth linking rod 26 is pivotably connected to the second pivotal portion 413 of the first adjusting member 41.

The first connecting member 42 is pivotably connected to the second pivotal portion 413 of the first adjusting member 41 and includes a first screw portion 421 slideably extending through the first adjusting track 411. The first knob 43 is in threading connection with the first screw portion 421 and selectively presses against the first adjusting member 41, such that the first connecting member 42 and the first knob 43 clamp the first adjusting member 41. The switch 48 is mounted to an end of the first connecting member 42 remote to the second pivotal portion 413.

The second adjusting member 45 includes a second adjusting track 451, a third pivotal portion 452, and a fourth pivotal portion 453. The second adjusting track 451 extends from a first side of the second adjusting member 45 through a second side of the second adjusting member 45 opposite to the first side of the second adjusting member 45. The third pivotal portion 452 is located between the second adjusting track 451 and the fourth pivotal portion 453. An end of the third linking rod 24 remote to the elongated member 21 is pivotably connected to the third pivotal portion 452. The sixth linking rod 27 is pivotably connected to the fourth pivotal portion 453 of the second adjusting member 45.

The second connecting member 46 is pivotably connected to the fourth pivotal portion 453 of the second adjusting member 45 and includes a second screw portion 461 slideably extending through the second adjusting track 451. The second knob 47 is in threading connection with the second screw portion 461 and selectively presses against the second adjusting member 45, such that the second connecting member 46 and the second knob 47 clamp the second adjusting member 45.

Figure 5:
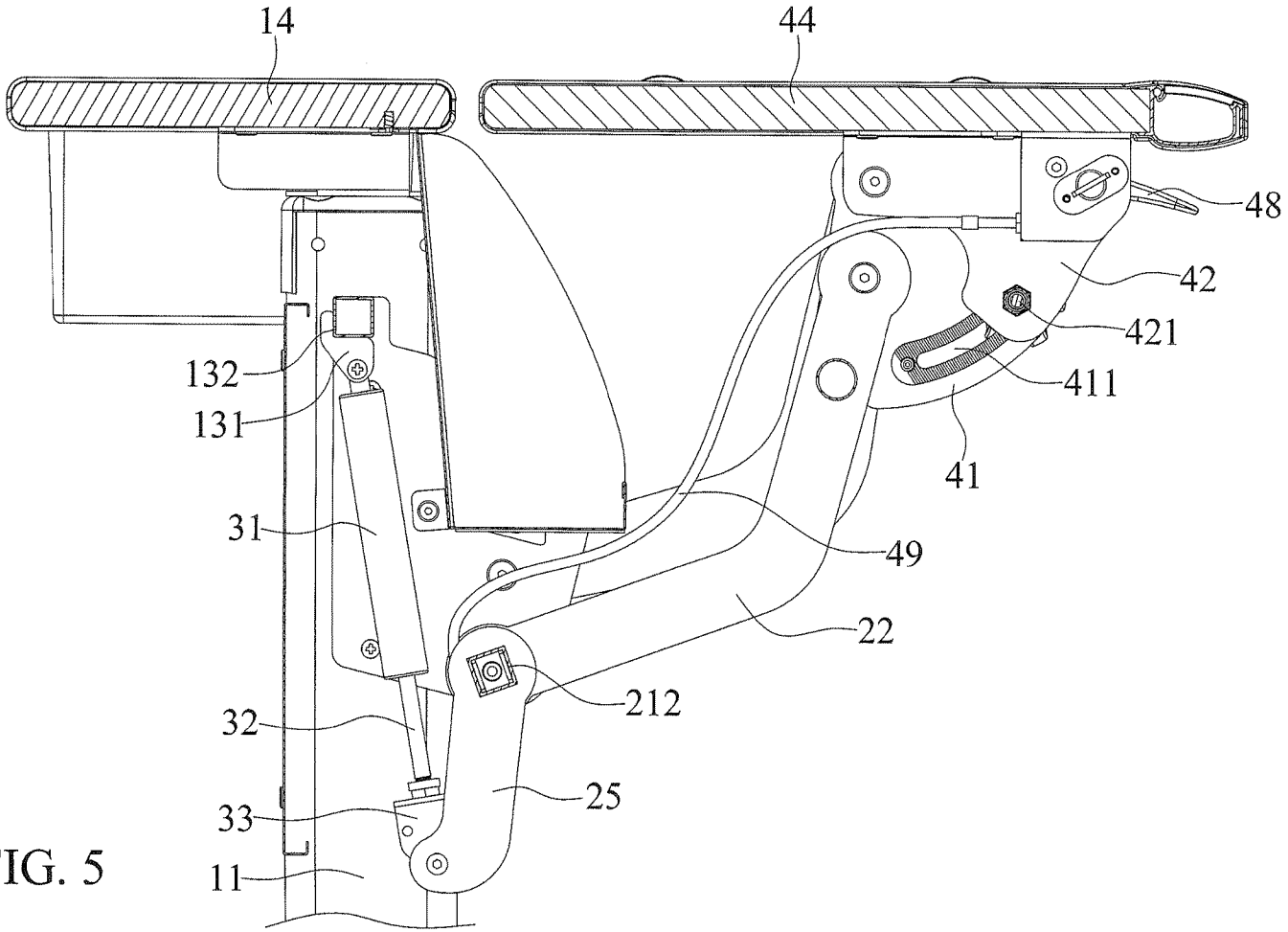
FIG. 5 is an enlarged view of a portion of the lift table of FIG. 4.
Figure 6:
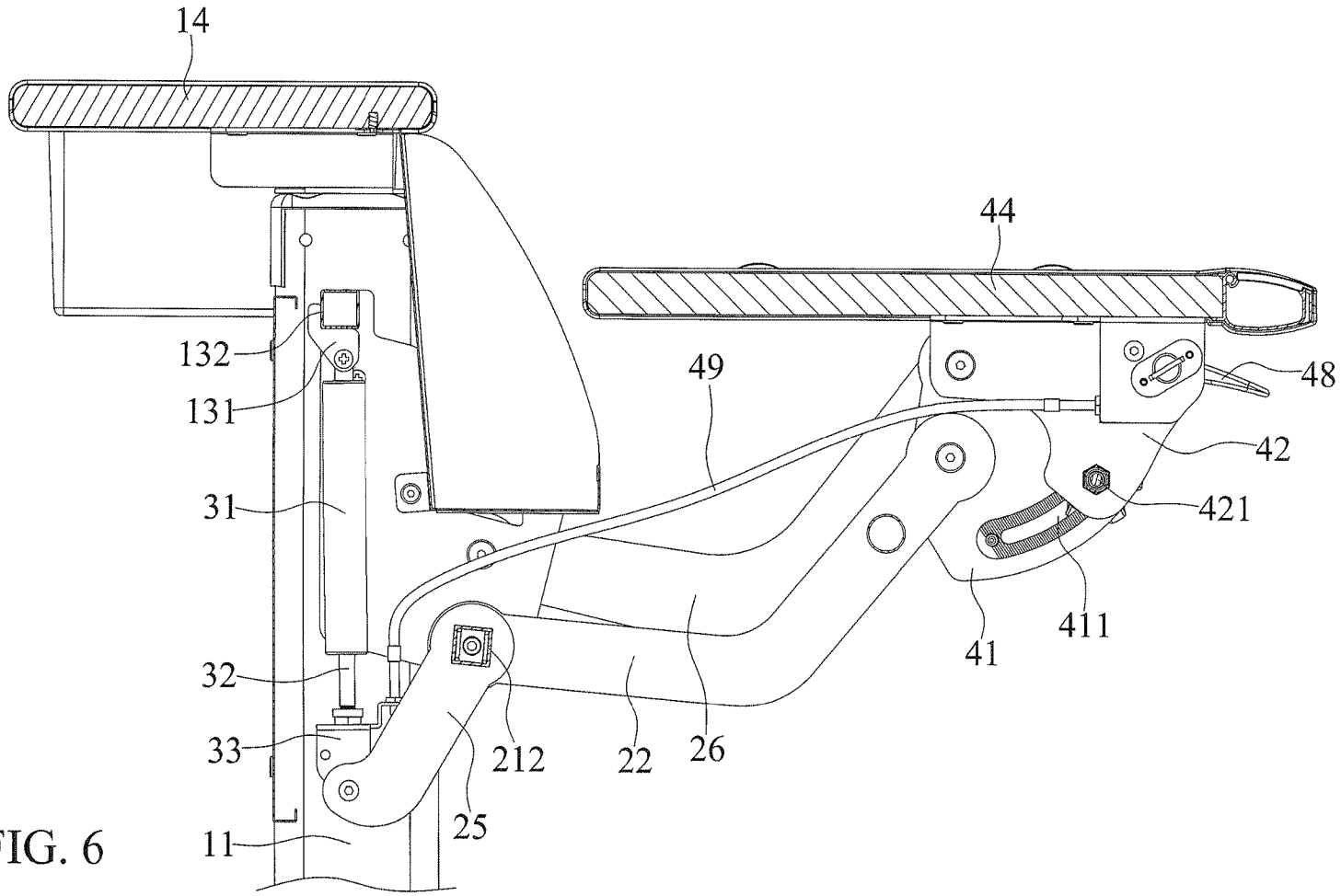
FIG. 6 is a view similar to FIG. 5, illustrating adjustment of a height of a top board of the lift table.

With reference to FIGS. 5, 6, when it is desired to adjust the height of the top board 44, the user firstly presses the switch 48 to actuate the actuating portion 33 via the actuation cord 49, such that the push rod 32 is slideable relative to the cylinder 31. Next, the top board 44 is lifted or lowered to the desired height. Finally, the switch 48 is released to prevent sliding movement of the push rod 32 relative to the cylinder 31, thereby fixing the top board 44 at the desired height.

Figure 3:
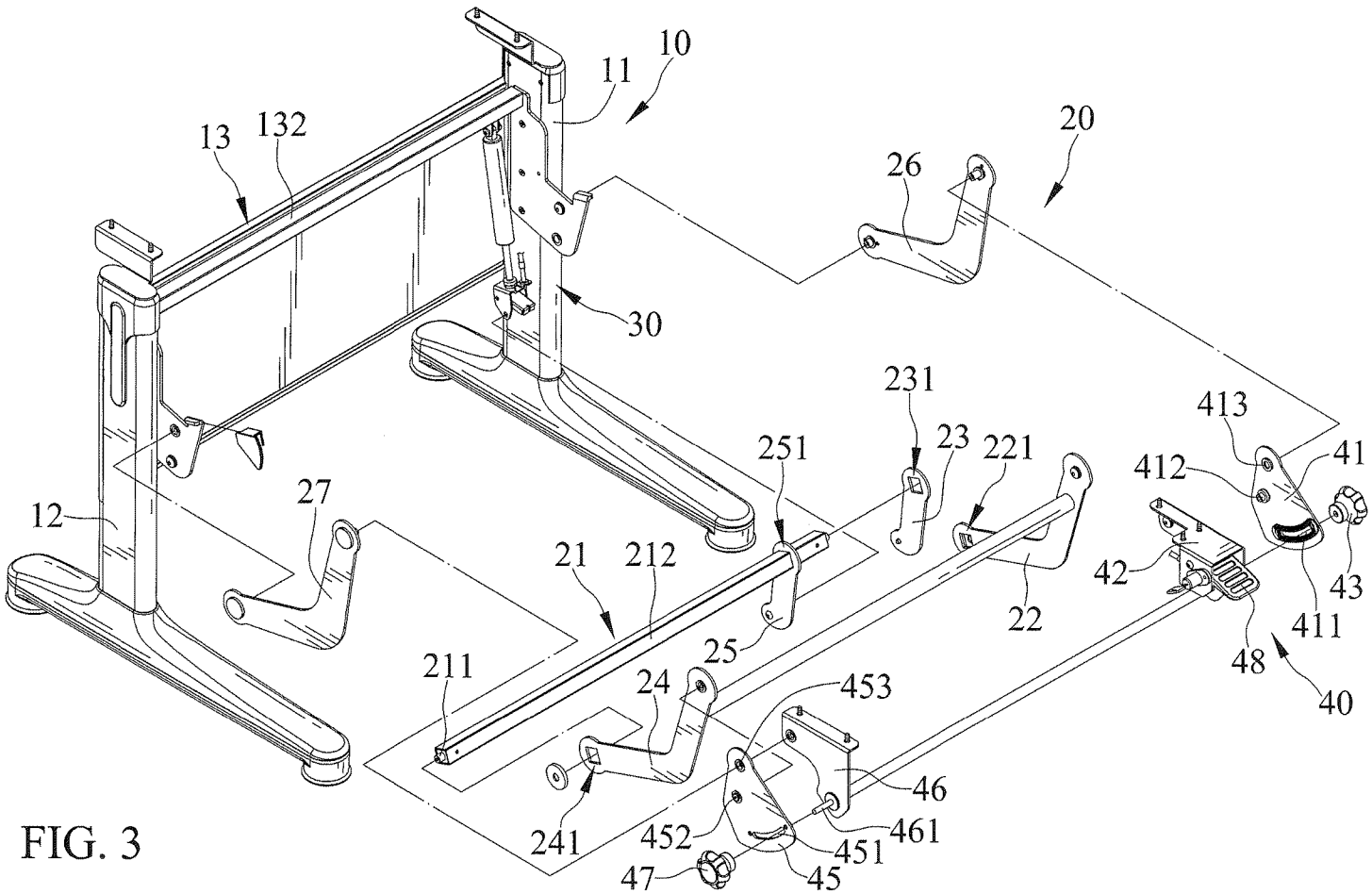
FIG. 3 is an exploded, perspective view of a linking rod unit and a base unit of the lift table of FIG. 1.
Figure 4:
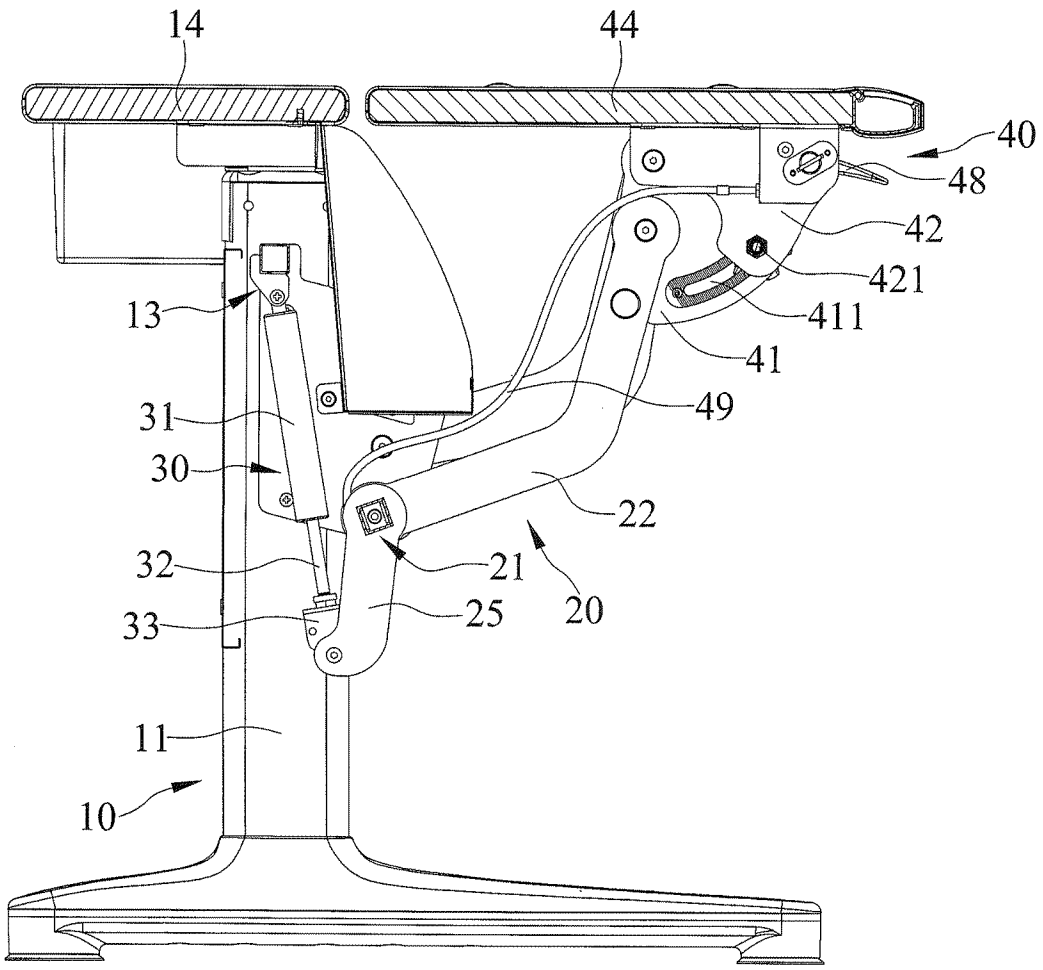
FIG. 4 is a cross sectional view of the lift table of FIG. 1.
Figure 7:
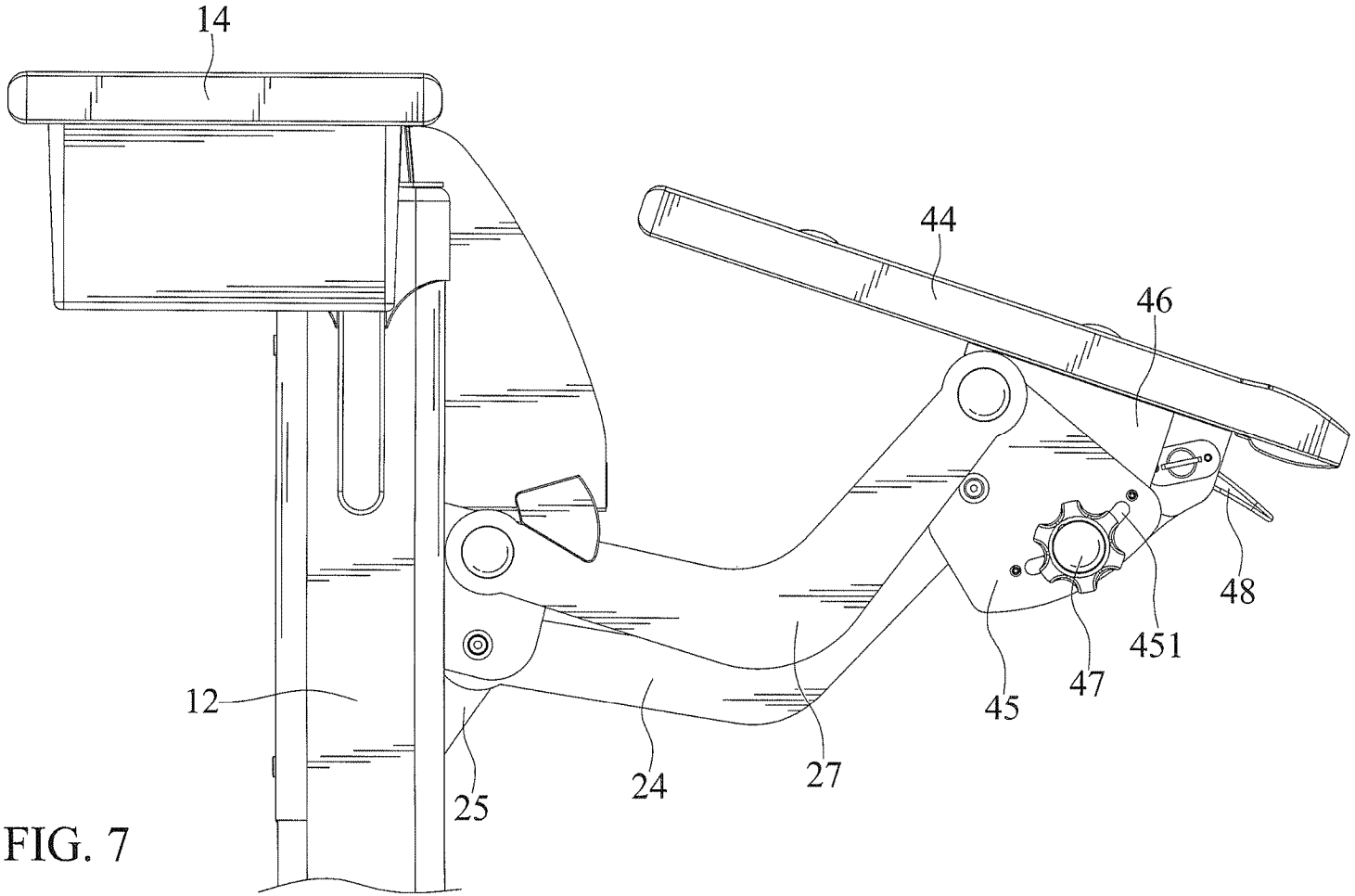
FIG. 7 is a partial, diagrammatic side view illustrating adjustment of an inclination angle of the top board of the lift table.

With reference to FIGS. 3, 6, 7, when it is desired to adjust the inclination angle of the top board 44, the user firstly rotates the first knob 43 to move the first knob 43 in a direction away from the first connecting member 42 and rotates the second knob 47 to move the second knob 47 in a direction away from the second connecting member 46. Next, the inclination angle of the top board 44 is adjusted to make the first screw portion 421 slide relative to the first adjusting track 411 and to make the second screw portion 461 slide relative to the second adjusting track 451. Finally, the first knob 43 is rotated to move in a direction toward the first connecting member 42, such that the first knob 43 and the first connecting member 42 clamp the first adjusting member 41. The second knob 47 is also rotated to move the second knob 47 in a direction toward the second connecting member 46, such that the second knob 47 and the second connecting member 46 clamp the second adjusting member 45. Thus, the top board 44 is positioned in the desired inclination angle.

In view of the foregoing, the lift table according to the present invention has the following advantages. The supporting beam 13 is connected between the first leg 11 and the second leg 12 to provide the base unit 10 with a better structural strength. Furthermore, the supporting beam 13 maintains the top board 44 of the top board unit 40 at the same height via the actuator 30 to provide the lift table with a stable structure. Furthermore, the user can adjust the height and the inclination angle of the top board 44.

Although specific embodiments have been illustrated and described, numerous modifications and variations are still possible without departing from the scope of the invention. The scope of the invention is limited by the accompanying claims.

The invention claimed is:

1. A lift table comprising:

a base unit including a first leg, a second leg, and a supporting beam connected between the first leg and the second leg;

a linking rod unit including an elongated member, a first linking rod, a second linking rod, and a third linking rod, wherein the elongated member is connected to the first linking rod, the second linking rod and the third linking rod and is pivotably connected to the first leg and the second leg, wherein the first linking rod, the second linking rod and the third linking rod are pivotable together with the elongated member relative to the first leg and the second leg and are pivotable relative to the base unit;

an actuator includes a first end pivotably connected to the supporting beam and a second end pivotably connected to the second linking rod, wherein the actuator is telescopic; and a top board unit pivotably connected to the first linking rod and the third linking rod and including a switch, wherein the switch is operable to actuate the actuator to proceed with a telescope movement, causing the first linking rod to pivot relative to the first leg and causing the third linking rod to pivot relative to the second leg, thereby lifting or lowering the top board unit, wherein the supporting beam includes a supporting portion, wherein the actuator includes a cylinder, a push rod, and an actuating portion, wherein the cylinder is pivotably connected to the supporting portion, wherein the push rod includes a first end slideably received in the cylinder and a second end, wherein the actuating portion is connected to the second end of the push rod and is pivotably connected to the second linking rod, wherein the top board unit includes an actuation cord having a first end connected to the switch and a second end connected to the actuating portion, wherein when the switch is not pressed, the push rod is not slideable relative to the cylinder, and wherein when the switch is pressed, the actuating portion is actuated via the actuation cord, and the push rod is slideable relative to the cylinder.

2. The lift table as claimed in claim 1, wherein the linking rod unit further includes a fourth linking rod connected to the elongated member and located between the second linking rod and the third linking rod, wherein the fourth linking rod and the second linking rod are respectively connected to two opposite sides of the actuating portion, and wherein the second linking rod and the fourth linking rod are synchronously pivotable relative to the base unit.

3. The lift table as claimed in claim 2, wherein the supporting beam further includes an extension portion having a first end connected to the first leg and a second end connected to the second leg, wherein the supporting portion is connected to an end of the extension portion adjacent to the first leg, wherein the elongated member includes two connecting portions and a beam portion, wherein the two connecting portions are respectively located on two opposite ends of the beam portion, wherein one of the two connecting portions is pivotably connected to the first leg, wherein another of the two connecting portions is pivotably connected to the second leg, wherein the beam portion is connected to the first linking rod, the second linking rod, the third linking rod, and the fourth linking rod.

4. The lift table as claimed in claim 3, wherein the first linking rod includes a first through-hole, wherein the second linking rod includes a second through-hole, wherein the third linking rod includes a third through-hole, wherein the fourth linking rod includes a fourth through-hole, and wherein the elongated member extends through the first through-hole, the second through-hole, the third through-hole, and the fourth through-hole.

5. The lift table as claimed in claim 4, wherein the extension portion includes square cross sections, wherein the beam portion includes square cross sections, and wherein each of the first through-hole, the second through-hole, the third through-hole, and the fourth through-hole includes square cross sections corresponding to the square cross sections of the beam portion.

6. A lift table comprising:

a base unit including a first leg, a second leg, and a supporting beam connected between the first leg and the second leg;

a linking rod unit including an elongated member, a first linking rod, a second linking rod, and a third linking rod, wherein the elongated member is connected to the first linking rod, the second linking rod and the third linking rod and is pivotably connected to the first leg and the second leg, wherein the first linking rod, the second linking rod and the third linking rod are pivotable together with the elongated member relative to the first leg and the second leg and are pivotable relative to the base unit;

an actuator includes a first end pivotably connected to the supporting beam and a second end pivotably connected to the second linking rod, wherein the actuator is telescopic; and a top board unit pivotably connected to the first linking rod and the third linking rod and including a switch, wherein the switch is operable to actuate the actuator to proceed with a telescope movement, causing the first linking rod to pivot relative to the first leg and causing the third linking rod to pivot relative to the second leg, thereby lifting or lowering the top board unit, wherein the top board unit includes a first adjusting member, a first connecting member, a first knob, and a top board, wherein the first adjusting member includes a first adjusting track, a first pivotal portion, and a second pivotal portion, wherein the first adjusting track extends from a first side of the first adjusting member through a second side of the first adjusting member opposite to the first side of the first adjusting member, wherein the first pivotal portion is located between the first adjusting track and the second pivotal portion, wherein an end of the first linking rod remote to the elongated member is pivotably connected to the first pivotal portion, wherein the first connecting member is pivotably connected to the second pivotal portion of the first adjusting member and includes a first screw portion slideably extending through the first adjusting track, wherein the first knob is in threading connection with the first screw portion and selectively presses against the first adjusting member, wherein the first connecting member and the first knob clamp the first adjusting member, wherein the first connecting member is connected to the top board, and wherein the switch is mounted to an end of the first connecting member remote to the second pivotal portion.

7. The lift table as claimed in claim 6, wherein the top board unit further includes a second adjusting member, a second connecting member, and a second knob, wherein the second adjusting member includes a second adjusting track, a third pivotal portion, and a fourth pivotal portion, wherein the second adjusting track extends from a first side of the second adjusting member through a second side of the second adjusting member opposite to the first side of the second adjusting member, wherein the third pivotal portion is located between the second adjusting track and the fourth pivotal portion, wherein an end of the third linking rod remote to the elongated member is pivotably connected to the third pivotal portion, wherein the second connecting member is pivotably connected to the fourth pivotal portion of the second adjusting member and includes a second screw portion slideably extending through the second adjusting track, wherein the second knob is in threading connection with the second screw portion and selectively presses against the second adjusting member, wherein the second connecting member and the second knob clamp the second adjusting member, and wherein the second connecting member is connected to a side of the top board opposite to the first connecting member.

8. The lift table as claimed in claim 7, wherein the linking rod unit further includes a fifth linking rod and a sixth linking rod, wherein the fifth linking rod includes a first end pivotably connected to the first leg and a second end pivotably connected to the second pivotal portion of the first adjusting member, and wherein the sixth linking rod includes a first end pivotably connected to the second leg and a second end pivotably connected to the fourth pivotal portion of the second adjusting member.

* * * * *